US010507972B2

(12) United States Patent
Christensen

(10) Patent No.: US 10,507,972 B2
(45) Date of Patent: Dec. 17, 2019

(54) FOLDABLE TANK WITH EXTENDED CAPACITY

(71) Applicant: FOL-DA-TANK COMPANY, Milan, IL (US)

(72) Inventor: Chad A. Christensen, Coal Valley, IL (US)

(73) Assignee: FOL-DA-TANK, Milan, IL (US)

( * ) Notice: Subject to any disclaimer, the term of this patent is extended or adjusted under 35 U.S.C. 154(b) by 149 days.

(21) Appl. No.: 15/239,592

(22) Filed: Aug. 17, 2016

(65) Prior Publication Data

US 2017/0183148 A1 Jun. 29, 2017

Related U.S. Application Data

(60) Provisional application No. 62/240,558, filed on Oct. 13, 2015.

(51) Int. Cl.

| | |
|---|---|
| ***B65D 88/00*** | (2006.01) |
| ***A62C 27/00*** | (2006.01) |
| ***B65D 88/16*** | (2006.01) |

(52) U.S. Cl.

CPC ..... *B65D 88/005* (2013.01); *A62C 27/00* (2013.01); *B65D 88/1656* (2013.01)

(58) Field of Classification Search

CPC .. B65D 88/005; B65D 88/1656; B65D 88/22; A62C 27/00

USPC ..... 220/9.2

See application file for complete search history.

(56) References Cited

U.S. PATENT DOCUMENTS

| | | | | |
|---|---|---|---|---|
| 7,938,291 | B2 | 11/2011 | Christensen | |
| 2001/0032846 | A1* | 10/2001 | Joshi | B65D 88/1656 220/4.13 |
| 2016/0229626 | A1* | 8/2016 | Claeys | B65D 90/205 |

* cited by examiner

*Primary Examiner* — Andrew T Kirsch
*Assistant Examiner* — Don M Anderson
(74) *Attorney, Agent, or Firm* — Shlesinger, Arkwright & Garvey LLP

(57) ABSTRACT

A foldable water tank comprises a foldable receptacle including an open receptacle portion and a closed receptacle portion, the open receptacle portion communicating with the closed receptacle portion such that water from the open receptacle flows to the closed receptacle, the open receptacle portion including side walls; a folding frame operably associated with the side walls to support the sidewalls in an upright position; and the closed receptacle portion extending outwardly from the frame.

12 Claims, 5 Drawing Sheets

FOLDABLE TANK WITH EXTENDED CAPACITY

RELATED APPLICATION

This is a nonprovisional application of Provisional Application Ser. No. 62/240,558, filed Oct. 13, 2015, hereby incorporated by reference.

FIELD OF THE INVENTION

The present invention is generally directed to a foldable water tank and specifically to a foldable water tank having an extended capacity that fits within a single lane of travel of a road.

SUMMARY OF THE INVENTION

The present invention provides a foldable water comprising a foldable receptacle including an open receptacle portion and a closed receptacle portion, the open receptacle portion communicating with the closed receptacle portion such that water from the open receptacle flows to the closed receptacle, the open receptacle portion including side walls; a folding frame operably associated with the side walls to support the sidewalls in an upright position; and the closed receptacle portion extending outwardly from the frame.

DETAILED DESCRIPTION OF THE INVENTION

Figure 1:
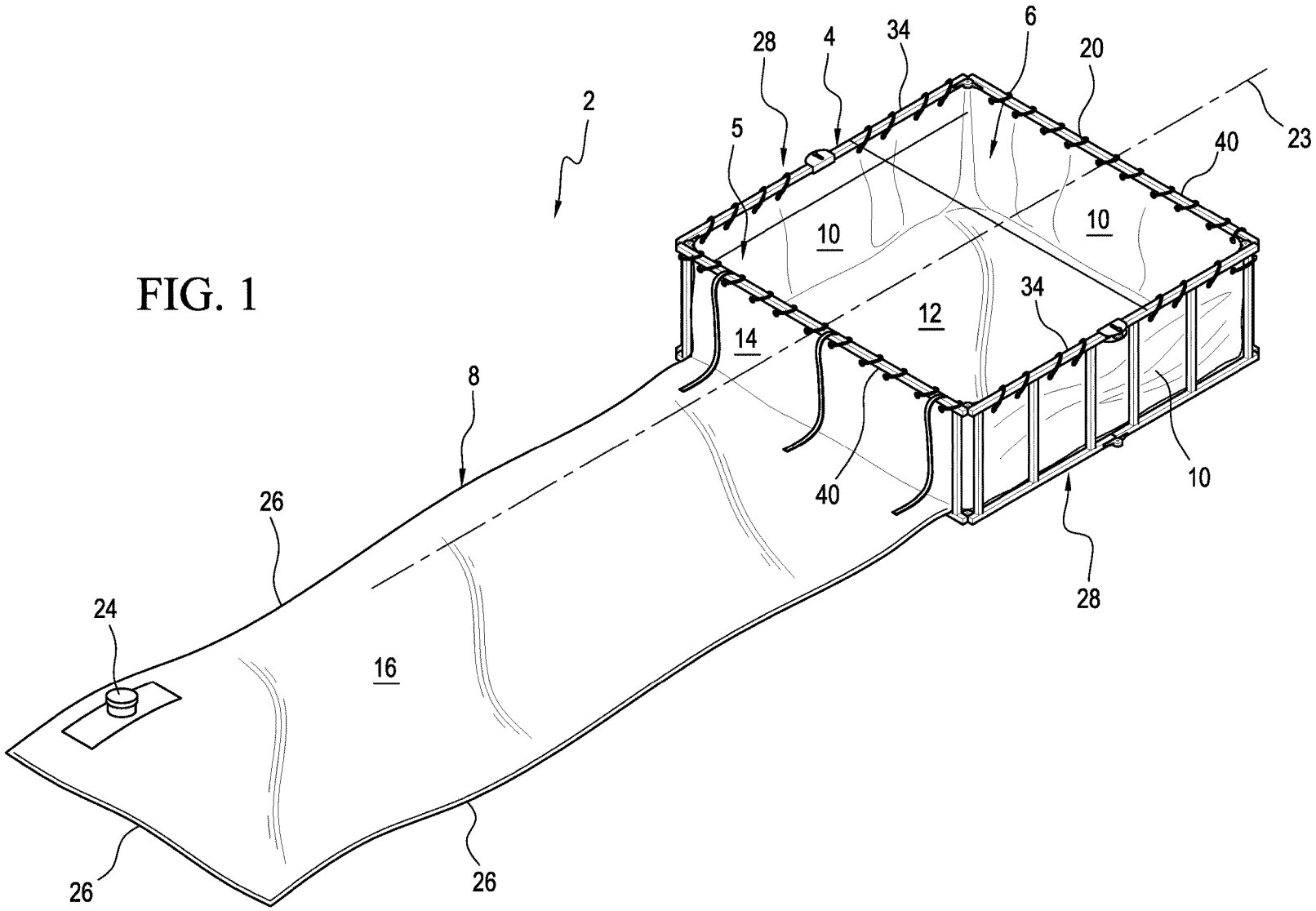
FIG. 1 is a perspective view of a foldable water tank embodying the present invention.
Figure 2:
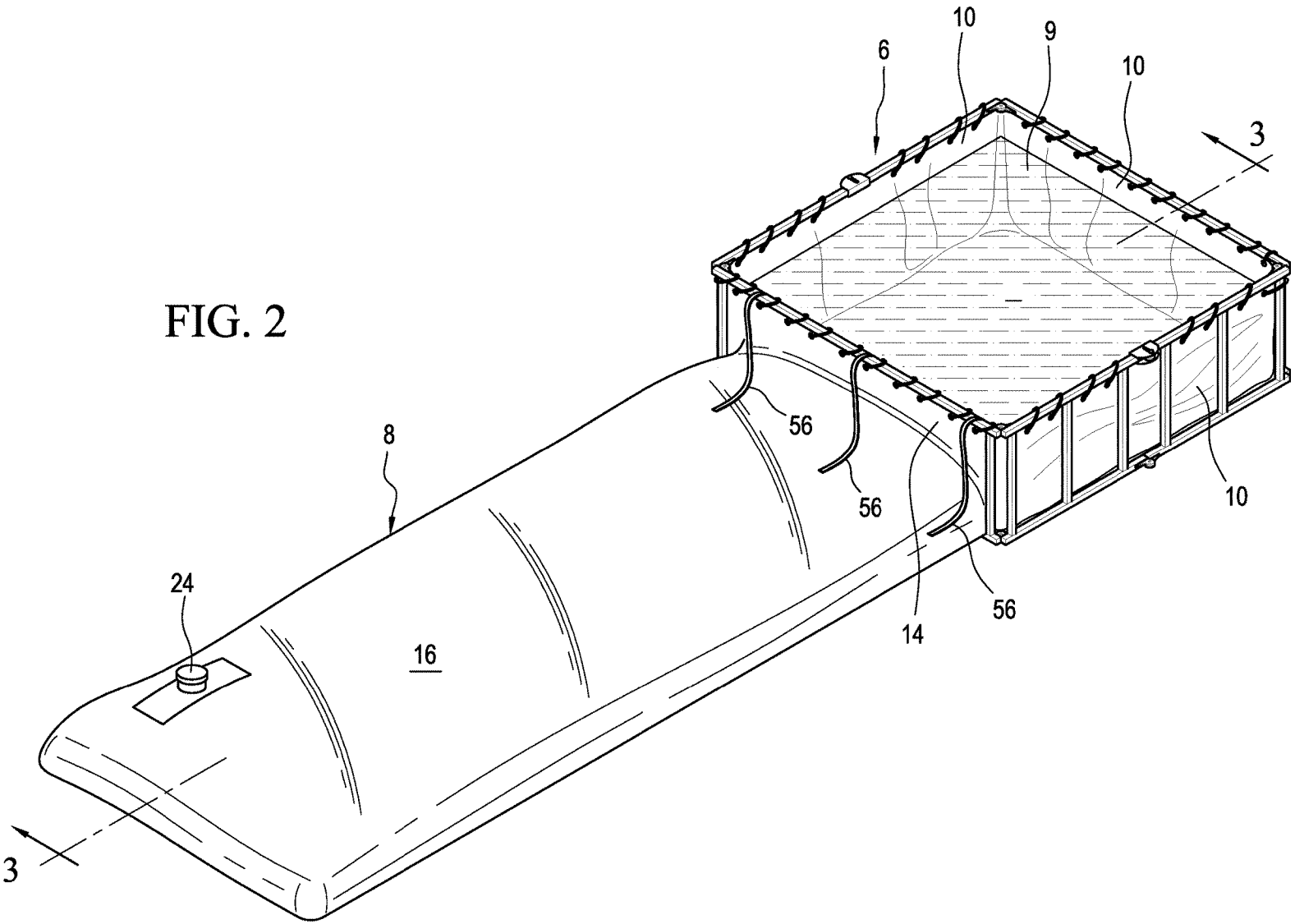
FIG. 2 shows the foldable tank of FIG. 1 filled with water.

A foldable tank 2 embodying the present invention is disclosed in FIG. 1. The tank 2 comprises a foldable frame 4, preferably square in plan view when unfolded with four sides, supporting a foldable receptacle 5 having an open receptacle portion 6 and a foldable closed receptacle portion 8 extending from the open receptacle portion 6. The receptacle 5 is preferably made from conventional water-tight material. The closed receptacle portion 8 may be seen as an extension of the open receptacle portion 6 made in the form of a bladder, extending outwardly from the frame 4. When the tank 2 is empty, the closed receptacle portion 8 is preferably flat for convenient folding and stowage. When the tank 2 is filled with water, the closed receptacle portion 8 swells up with water from the open receptacle portion 6, thereby advantageously providing additional capacity to open receptacle portion 6.

The open receptacle portion 6 includes side walls 10 supported by the frame 4 and a bottom wall 12. A side wall 14 is supported by the frame 4 and is attached to a top wall 16 of the closed receptacle portion 8 to form a continuous top wall. A bottom wall 18 (see FIG. 3) of the closed receptacle portion 8 is attached to the bottom wall 12 to form a continous bottom wall. Thus it can be seen that closed receptacle 8 opens up into the closed receptacle 6 such that water flows freely between the open receptacle portion 6 and the closed receptacle portion 8. Cord 20 is threaded through openings 21 along the upper edge portions of the side walls 10 and 14 and wound around the top rails 34 and 40 of the frame 4.

The closed receptacle 8 extends away from the frame 4 at the side wall 14 along a central axis 23 parallel to the two opposed sides 28 of the frame 4. The closed receptacle 8 is preferably rectangular in plan view, with substantially the same width as the width of the frame 4 so that it occupies the same lane of the road on which the open receptacle 6 is deployed, and when folded the closed receptacle 8 is substantially the same width as the width of the frame 4. A connector 24 (shown with a cap) for connecting to a hose (not shown) is advantageously provided at an end portion of the closed receptacle portion 8 for drawing water from the tank 2. The connector 24 is preferably attached to the top wall 16.

The closed receptacle portion 8 may be formed by joining two overlapping sheet materials and joining their three outer edges 26 by standard means and joining the remaining edges to the respective side wall 14 and the bottom wall 12.

Figure 3:
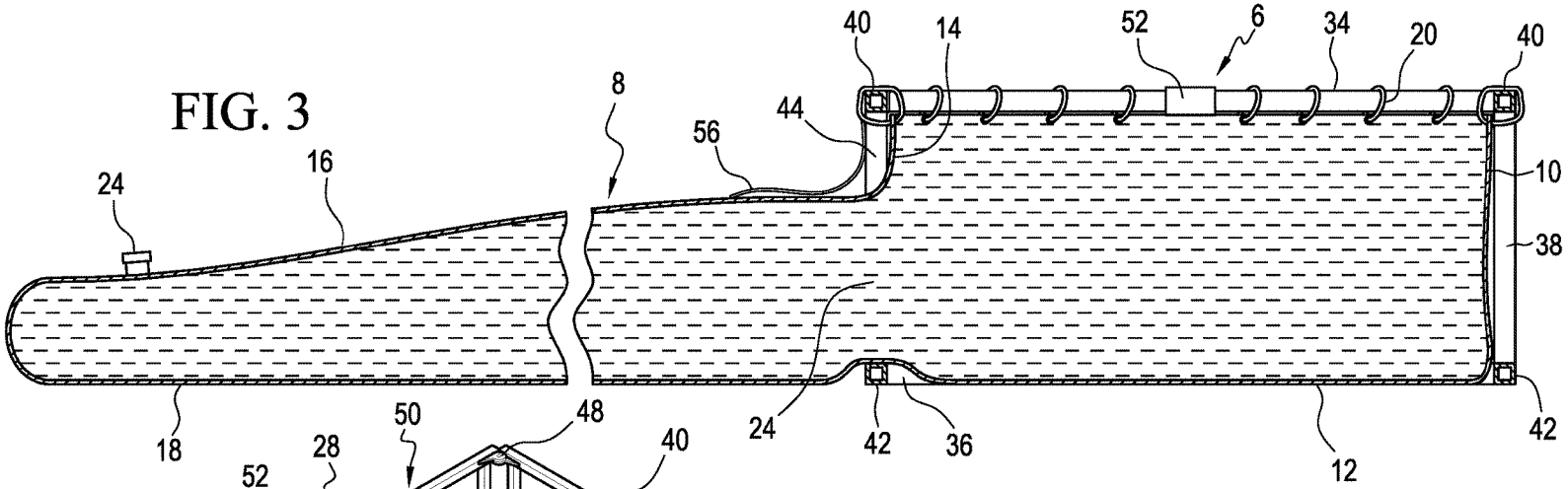
FIG. 3 is a cross-sectional view taken along line 3-3 in FIG. 2.

Referring to FIG. 3, the closed receptacle portion 8 will expand to a volume as water 9 from the open receptacle portion 6 finds its way into the closed receptacle portion 8. The side wall 14 of the open receptacle portion 6 may be seen as an extension of the top wall 16 of the closed receptacle portion 8. Similarly, the bottom wall 12 may also be seen as an extension of the bottom wall 18. Thus, an opening 24 into the open receptacle portion 6 is formed between the top wall 16 and the bottom wall 18. The opening 24 allows the water from the open receptacle 6 to flow and fill up the closed receptacle 18. The closed receptacle portion 8 advantageously expands the capacity of the open receptacle portion 6 without increasing its width, thereby keeping the width of the tank 2 to within the width of a single lane of a road. By making the tank 2 to fit within a single lane of a road, vehicular traffic would not be impeded, especially in a two lane road where the other lane is available for vehicle traffic. The tank 2 is advantageously narrow enough but provides capacity normally provided by a larger and wider tank that exceeds the width of a single lane.

The closed receptacle portion 8 may also be provided at the opposite side of the frame 4 to provide even more capacity for the foldable tank 2.

The preferred capacity specified by most fire departments is 2000 gallons or more, which increases the footprint of the standard tank frames to 11' or more. Using such standard tanks on narrow county roads, which may only be 14'-16' wide, creates a hazard by either risking damage to the portable tank by setting up the frame to overhang the drainage ditch on the road side, or if the tank frame is fully on the pavement (or gravel) the water tanker truck must veer off on to the shoulder toward the opposite side of the road and risk rollover. The tank 2 advantageously provides the preferred capacity without impinging into the adjacent travel lane.

Many fire trucks cannot store a folding tank frame, which is longer than 8' on the storage rack on their trucks. For example, a popular 2100 gallon folding frame tank is 11'3" L×11' W. A 2000 gallon rectangular frame is 14' L×8' W. The tank 2 advantageously provides a folded dimension of about 8' that is suitable for storage on the fire truck rack while at the same time providing the preferred capacity.

Figure 4:
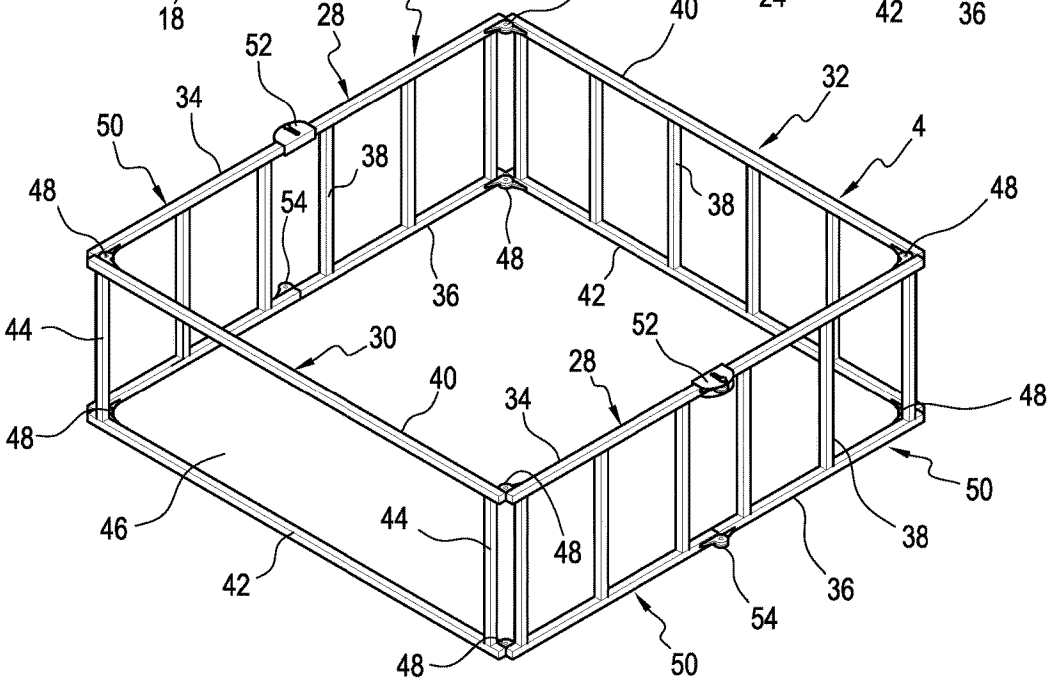
FIG. 4 is perspective view of a frame of the tank of FIG. 1.

Referring to FIG. 4, the frame 4 is preferably 4-sided. The frame 4 has a pair of opposite sides 28 and another pair of opposite sides 30 and 32. Each of the sides 28 includes a pair of top rails 34 and a pair of bottom rails 36. A plurality of posts 38 joins the bottom rails 36 to the respective top rails 34. Each of the sides 30 and 32 includes a top rail 40 and a bottom rail 42. The side 32 includes a plurality of vertical posts 38 joining the bottom rail 42 to the respective top rail 32. The side 30 only has vertical posts 44 at the respective corners to provide an opening 46 framed by the top rail 30, the bottom rail 42 and the corner posts 44 to allow the closed receptacle portion 8 to be joined to the open receptacle portion 6. The side 30 advantageously does not bend at the center, unlike the sides 28 so that a rigid support is provided for the closed receptacle portion 8 at the opening 46.

The sides 30 and 32 are attached to the corresponding sides 28 with hinges 48 secured to the respective corners of the adjacent sides. Each of the sides 28 is made of two sections 50 attached to each other with hinges 52 and 54. The frame 4 is preferably made from tubular members of any cross-sectional shape, such as square or circular.

Figure 5:
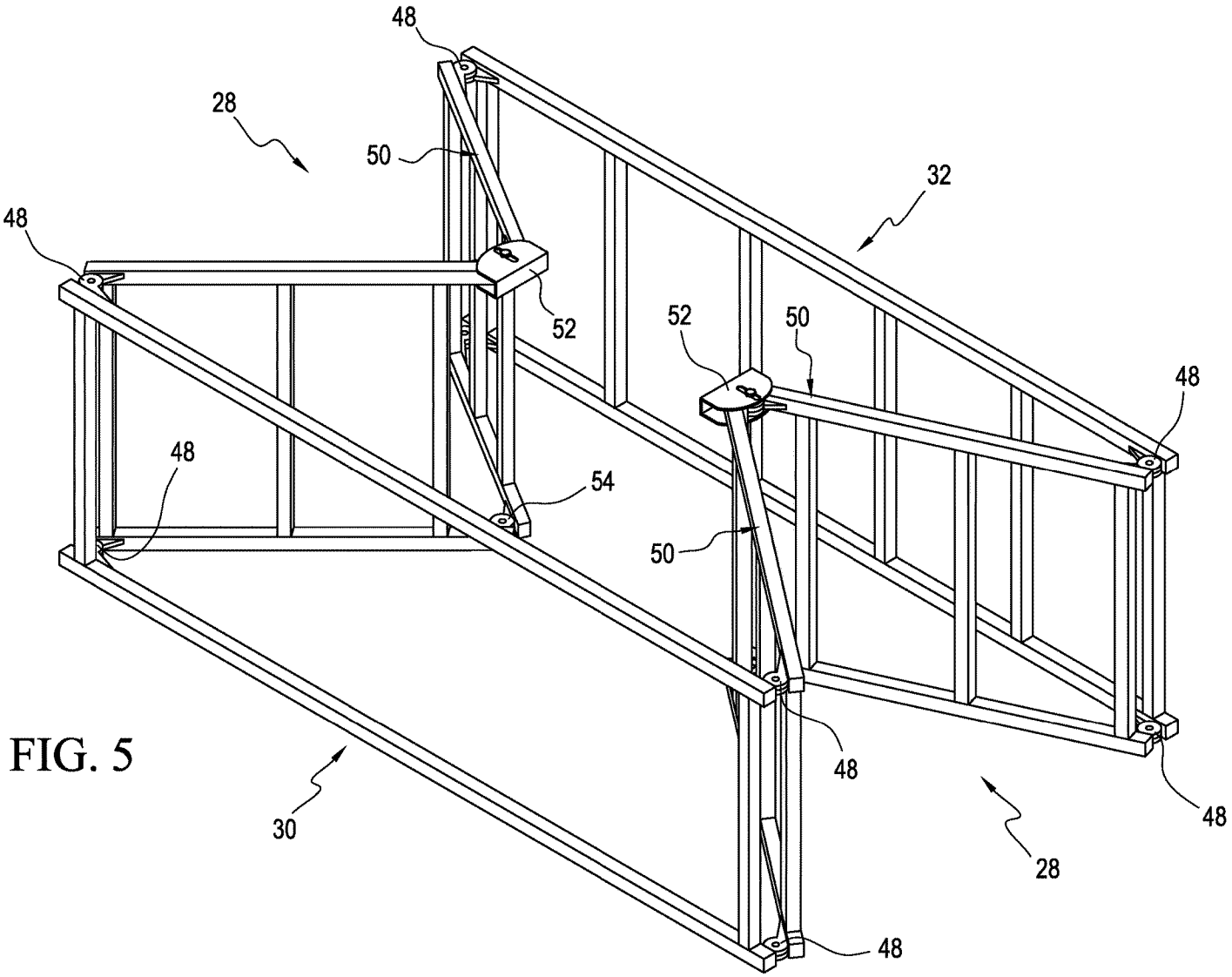
FIG. 5 is a perspective view of the frame of FIG. 4 shown partly folded.

Referring to FIG. 5, the frame 4 is shown in a partially folded position (the receptacle 5 is not shown for clarity but should be understood that the receptacle 5 remains attached to the frame 4 as the frame is folded). The hinges 48, 52 and 54 advantageously allow the frame 4 to be folded into a compact, substantially flat configuration, where the top and bottom rails of the sides 30 and 32 are parallel to each other. The frame 4 is folded flat by folding the sides 28 via the sections 50 and the hinges 48, 52 and 54. The hinges 48, 52 and 54 advantageously allow the inward rotation of the sections 50 toward the respective sides 30 and 32 such that the tank 2 may be folded into a compact, substantially flat shape. The hinges advantageously allow rotation of the sections 50 to accomplish the folding.

The hinges 48 may be the same as the hinges 54. The hinges 52 are disclosed in U.S. Pat. No. 7,938,291, hereby incorporated by reference. The hinges 52 advantageously protect the user's hand from being pinched during folding or unfolding of the tank 2.

Figure 6:
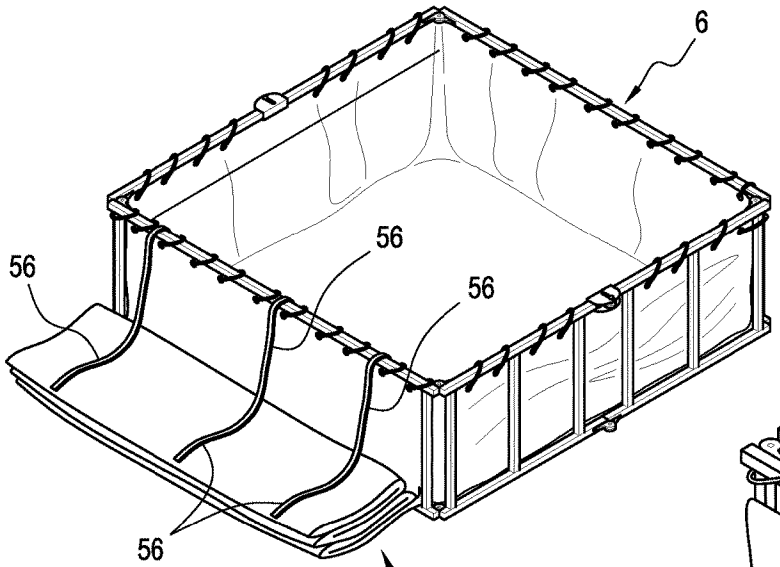
FIG. 6 is a perspective view of the tank of FIG. 1, showing a portion of the tank folded.

Referring to FIGS. 1 and 6, the closed receptacle portion 8 lays flat when empty, and is then folded, preferably at approximately 24 inch increments, until it reaches the base of the frame 4. A series of webbing straps 56 with double "D" ring cinching straps with VELCRO are preferably used to secure the folded closed receptacle portion 8 to the frame 4.

Figure 7:
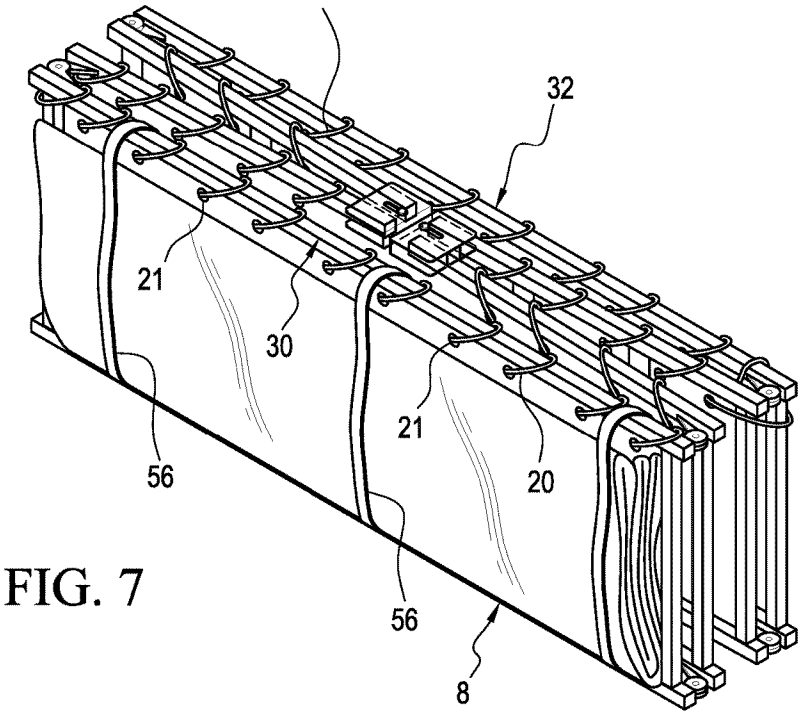
FIG. 7 is a perspective view of the tank of FIG. 1 completely folded for stowage or transport.

Referring to FIG. 7, the foldable tank 2 is shown completely folded in substantially flat and compact configuration. The closed receptacle portion 8 is attached to the side 30 of the frame 4 when folded. Even with the increased capacity afforded by the closed receptacle portion 8, the folded length of the tank 2 is suitable for stowage on a typical fire truck. The tank 2 when folded is about 8'3" long.

The tank 2 advantageously doubles or triples the capacity of any standard folding tank. The tank 2 is only as wide as a fire truck and therefore does not impede traffic flow on narrow rural roads, but provides a larger water capacity on a smaller profile. The tank 2 further allows existing water tender trucks to carry single lane style tanks without having to lengthen the frame as in the original rectangular folding tanks. For example, a standard 2000 gallon square folding tank measures 11' 3" square. To make that capacity function in a "single lane" configuration, the proportions must be 8' wide, but stretched to 14' in length. With the tank 2 of the present invention, the tank frame is about 8'3" square, with up to a 16' extension provided by the closed receptacle portion 8 to advantageously increase the capacity up to 2500 gallons and still fit within a single lane of the road, thereby avoiding impeding oncoming traffic on a narrow rural road.

The capacity of the tank 2 may still be extended by installing a second closed receptacle portion 8 to the side 32 of the frame 4. The vertical posts 38 shown will have to be removed to provide a large opening such as the opening 46 at the side 30. The second closed receptacle portion 8 will extend outwardly from the frame 4 in the opposite direction as the first closed receptacle portion 8 shown in FIG. 1. Accordingly, the closed receptacle portion 8 advantageously doubles (with one extension) or triples (with two extensions) the tank capacity on any size standard or custom size folding frame tank. Since the frame 4 has a single lane width, its use on narrow rural roads will advantageously not impede vehicular traffic, since only a single lane of the road will be occupied by the tank 2 when deployed. This is useful for fire departments that regularly run water shuttling operations on narrow rural roads.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A foldable water tank, comprising:

a) a foldable receptacle including an open receptacle portion and a closed receptacle portion, the open receptacle portion communicating with the closed receptacle portion through an unobstructed opening such that water from the open receptacle flows to the closed receptacle, the open receptacle portion including side walls;

b) a folding frame operably associated with the side walls to support the side walls in an upright position, the frame including a folding side and a non-folding side;

c) the closed receptacle portion extending outwardly from the non-folding side of the frame;

d) the non-folding side including a top rail, a bottom rail, first corner post joined to one end of the top rail and to one end of the bottom rail, a second corner post joined to an opposite end of the top rail and to an opposite end of the bottom rail; and e) the unobstructed opening extending from the first corner post at the one end of the top rail and the one end of the bottom rail to the second corner post at the opposite end of the top rail and the opposite end of the bottom rail.

2. A foldable water tank as in claim 1, wherein the closed receptacle portion includes a top wall operably attached to the top rail.

3. A foldable water tank as in claim 1, wherein:

a) the frame includes a central axis parallel to two opposed sides of the frame; and b) the closed receptacle portion extends outwardly along the central axis when in use.

4. A foldable water tank as in claim 1, wherein the closed receptacle portion includes a bottom wall operably attached to a bottom wall of the open receptacle portion.

5. A foldable water tank as in claim 1, wherein the closed receptacle portion when folded is attachable to a side of the frame.

6. A foldable water tank as in claim 1, wherein the closed receptacle portion includes a hose connector disposed at an end portion of the closed receptacle portion.

7. A foldable water tank as in claim 1, wherein the frame when unfolded for use is square in plan view.

8. A foldable water tank as in claim 1, wherein the frame includes posts joined to top rails and bottom rails.

9. A foldable water tank as in claim 1, wherein the closed receptacle portion has a width substantially the same as the width of the frame when the frame is folded.

10. A foldable water tank as in claim 3, wherein:

a) the closed receptacle portion when empty and laid flat is substantially rectangular oriented along the central axis; and b) the closed receptacle portion has a width substantially the same as the width of the frame.

11. A foldable water tank as in claim 8, wherein a cord is threaded through openings along edge portions of the side walls and wound around the top rails.

12. A foldable water tank as in claim 3, wherein the two opposed sides of the frame are foldable inwardly toward the central axis.

* * * * *